United States Patent [19]

Simpson

[11] 4,347,985

[45] Sep. 7, 1982

[54] MANUFACTURE OF GLASS FIBRE BLOWING WOOL

[75] Inventor: Robert B. Simpson, Sarnia Township, Lambton County, Canada

[73] Assignee: Fiberglas Canada Inc., Toronto, Canada

[21] Appl. No.: 83,968

[22] Filed: Oct. 11, 1979

[30] Foreign Application Priority Data

Aug. 3, 1979 [CA] Canada ..... 333125

[51] Int. Cl.[3] ..... B02C 19/12

[52] U.S. Cl. ..... 241/1; 156/344; 241/3; 241/4; 241/18; 241/57; 241/101.4

[58] Field of Search ..... 83/302; 156/344, 584; 241/3, 4, 5, 18, 25, 41, 57, 60, 167, 1, 101 A, 101.4, 39

[56] References Cited

U.S. PATENT DOCUMENTS

| | | | |
|---|---|---|---|
| 1,417,961 | 5/1922 | Williams . | |
| 2,145,899 | 2/1939 | Simpson | 83/302 X |
| 2,219,285 | 10/1940 | Allen et al. | 83/302 X |
| 2,225,781 | 12/1940 | Hinerfeld . | |
| 2,233,433 | 3/1941 | Smith . | |
| 2,375,284 | 5/1945 | Coss . | |
| 2,579,035 | 12/1951 | Edelman . | |
| 2,679,933 | 6/1954 | Lockhart . | |
| 3,584,796 | 6/1971 | Earle | 241/4 |

FOREIGN PATENT DOCUMENTS

| | | | |
|---|---|---|---|
| 897664 | 4/1972 | Canada . | |
| 637398 | 12/1978 | U.S.S.R. | 83/302 |

*Primary Examiner*—Mark Rosenbaum

*Attorney, Agent, or Firm*—Fleit & Jacobson

[57] ABSTRACT

A method of and apparatus for producing blowing wool from bonded glass fibre material are disclosed in which the glass fibre material is conveyed and cut into strips. These strips are then transversely cut to produce individual cut pieces of the glass fibre material, which are then delaminated in an air stream to produce a blowing wool.

10 Claims, 10 Drawing Figures

MANUFACTURE OF GLASS FIBRE BLOWING WOOL

FIELD OF THE INVENTION

The present invention relates to blowing wool and to methods of and apparatus for producing blowing wool from bonded glass fibre material.

DESCRIPTION OF THE PRIOR ART

Blowing wool, which is a type of insulation installed in attics and the like by the use of a suitable blower and flexible ducting, has in the past normally been manufactured by breaking up bonded glass fibre material in a hammermill.

In U.S. Pat. No. 3,584,796, issued June 15, 1971 to Paul L. Earle et al., there is described a method of producing glass fibre blowing wool by cutting bonded glass fibre material and immediately removing the severed material from the cutting area by suction through a screen.

The cutting is effected by feeding the bonded glass fibre material on an upwardly inclined endless belt conveyor to a preliminary cutter or shredder located at an inlet to a hopper. The preliminary cutter or shredder is a rotary cutter having a pair of flying knives or rotary knives cooperating with a stationary bed knife located adjacent the terminal portion of the conveyor.

The glass fibre material, cut by the preliminary cutter, falls in the hopper to a second or main cutter which, again, comprises a rotary cutter.

Beneath the main cutter there is provided a screen containing openings of a size corresponding to the maximum particle size it is desired to produce, and a fan for pulling the particles through the screen and passing them to further suitable conduits to other handling and packaging stations.

These prior methods of producing blowing wool are disadvantageous, firstly, because the blowing wool produced thereby is of a relatively non-uniform nature. Consequently, the blowing density of the wool, that is the density of the wool when it has been installed in situ in an attic, can vary considerably. Therefore, the thermal values of a given depth of the blowing wool, when installed, cannot be accurately predicted, and therefore, the R value of the installed blowing wool is subject to unpredictable variation.

Furthermore, the use of a hammermill, or the use of a pair of rotary cutters to break down the incoming bonded glass fibre material, not only results in fibres and blown wool particles of random size, but also damages the fibres by repeated impacting or cutting of the fibres, and thus tends to produce a relatively large amount of dust, which is highly undesirable both at the site of the factory where the blowing wool is being manufactured, and also at the site where the blowing wool is being installed into an attic or the like.

OBJECT OF THE INVENTION

It is an object of the present invention to provide a novel and improved method and apparatus for producing blowing wool by firstly cutting glass fibre material into strips and then cutting across the strips to form individual cut pieces, in which the cut pieces are then reduced in size in a simple manner.

BRIEF SUMMARY OF THE INVENTION

According to the present invention, bonded glass fibre material, after being cut into strips and after the strips have been cut across their length to form individual cut pieces, is subjected to an air stream which causes the individual cut pieces to break and thus to become reduced in size.

More particularly, the invention is based on the understanding that, as is well known to those skilled in the art, bonded glass fibre material comprises lamination as a result of the deposition of successive veils of glass fibre during the deposition of the glass fibres onto a conveyor in a forming section. Consequently, a section through bonded glass fibre material contains a series of successive laminations arranged one above the other throughout the height of the material.

By cutting the material into the individual cut pieces, the material is sufficiently weakened to enable the cut pieces to be readily separated along the laminations by directing an air stream against the cut pieces.

In a preferred embodiment of the invention, the bonded glass fibre material strips are cut into the individual cut pieces at a rotary cutter, at which a first, downwardly directed steam of air impinges against the cut pieces and ensures that they drop into a receiving chamber below the rotary cutter. A second air stream is directed at the individual cut pieces, in the receiving chamber, in a direction extending across the receiving chamber, and entrains the cut pieces through a convergent passage or nozzle into a duct for conveyance to, for example, a bagging machine.

The impingement of the second air stream against the cut pieces in the receiving chamber, and their subsequent entrainment in the second air stream, has been found, in practice, to result in each of at least the majority of the cut pieces being broken by delamination into separate portions before passing from the duct means.

BRIEF DESCRIPTION OF THE DRAWINGS

The invention will be more readily understood from the following description of a preferred embodiment thereof given, by way of example, with reference to the accompanying drawings, in which.

DESCRIPTION OF PREFERRED EMBODIMENT

Figures 1, 2, 3, 4:
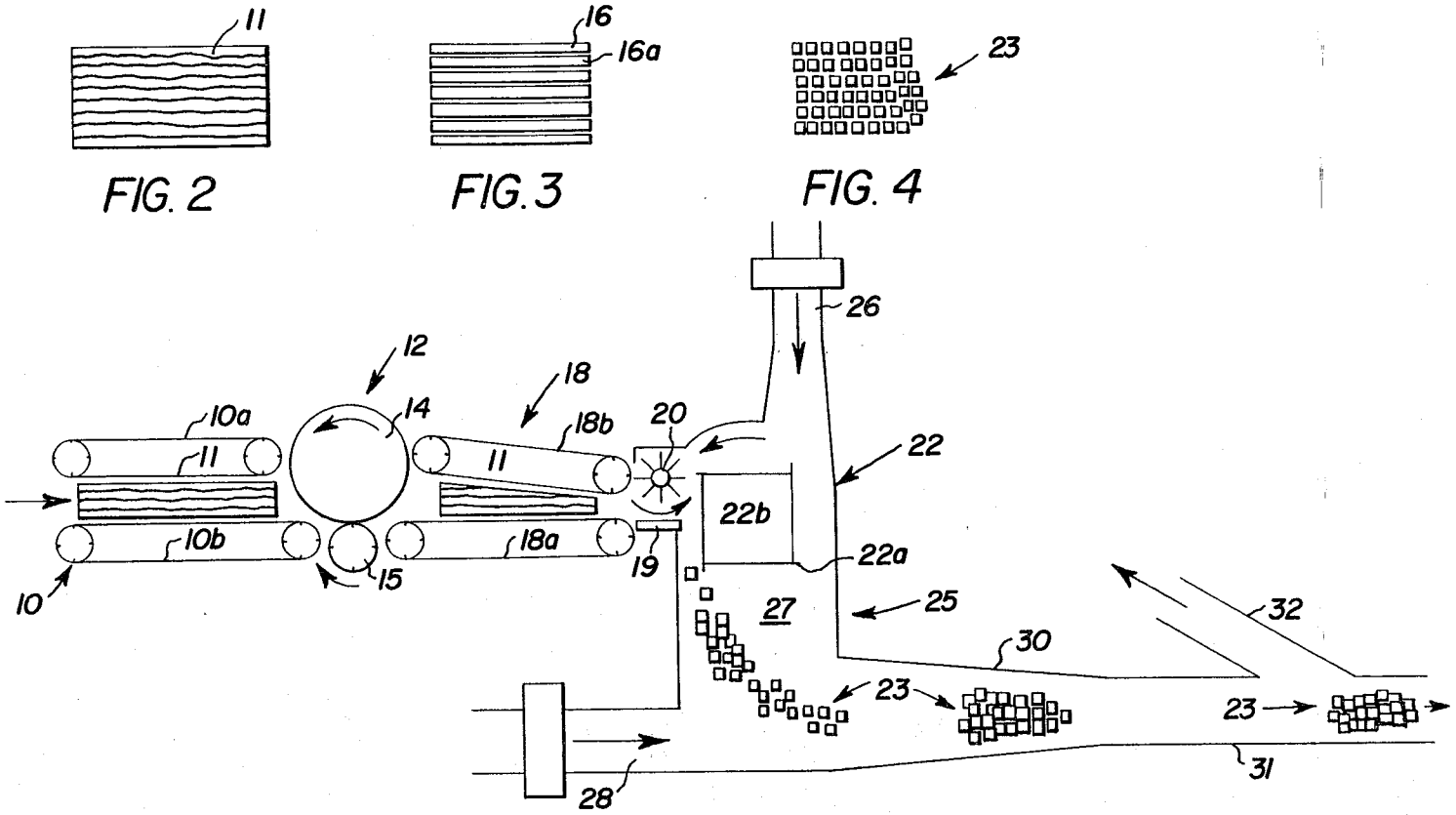
FIG. 1 shows a diagrammatic side view, in section, of apparatus for producing blowing wool from bonded glass fibre batt material.
FIG. 2 shows a diagrammatic plan view of the batt material fed into the apparatus of FIG. 1.
FIG. 3 shows a diagrammatic plan view of the batt material of FIG. 2 cut into strips.
FIG. 4 shows a diagrammatic plan view of the strips of FIG. 3 cut into individual cut pieces.

The apparatus illustrated in FIG. 1 has an inlet conveyor, indicated generally by reference numeral 10, in the form of a pinch conveyor comprising upper and lower endless conveyor belts 10*a* and 10*b* for receiving batts 11 of bonded glass fibre material fed into the apparatus.

The conveyor 10 feeds the batt material 11 to a first cutting station provided with a first cutter indicated generally by reference numeral 12.

The cutter 12 comprises a plurality of circular saw blades 14, of which only one is shown in FIG. 1, cooperating with a pinch roll 15 for cutting the batt material 11 therebetween into a plurality of batt material strips 16, as shown in FIG. 3, which are arranged side-by-side across the path of travel of the batt material through the apparatus and separated from one another by lines of cut 16*a* which, of course, are likewise spaced apart across the batt material path.

From the first cutter 12, the batt material, now cut into the strips 16, passes into a second conveyor indicated generally by reference numeral 18.

The second conveyor 18 is a pinch conveyor comprising a horizontal lower endless conveyor belt 18*a* and an upper endless conveyor belt 18*b* which is downwardly and forwardly inclined, i.e. which is convergent relative to the lower conveyor belt 18*b* in the direction of advance of the strips 16, and which therefore vertically compresses the strips 16.

From the second conveyor 18, the strips 16 pass over a support 19 beneath a vaned roller 20.

The vaned roller 20 precompresses the glass fibre material strips 16 and also controls the rate of feed of the glass fibre material 16 into a second cutting station, which is provided with a second cutter 22.

The second cutter 22 is a rotary cutter provided with four fly knives 22*a* equi-angularly mounted on a rotor 22*b*.

The fly knives 22*a* chop the bonded glass fibre material strips 16 into individual cut pieces indicated generally by reference numeral 23.

The second cutter 22 is enclosed in a housing indicated generally by reference numeral 25, which defines a first air inlet 26 above the rotary cutter 22, a hopper or receiving chamber 27 below the rotary cutter 22 and a second air inlet 28 communicating with the receiving chamber.

As indicated by the arrows in FIG. 1, a first air stream is directed into the housing 25 through the first air inlet 26, and passes between the top of the rotary cutter 22 and the housing to the position at which the bonded glass fibre material strips 16 are cut or chopped by the fly knives 22*a* to form the individual cut pieces 23.

This first air stream ensures that the cut pieces 23 separate from one another as they drop into the receiving chamber 27.

A second, main air stream is introduced through the second air inlet 28 and entrains the cut pieces 23 from the receiving chamber 27 through an outlet nozzle or convergent passage 30, which communicates at its inlet end with a side of the receiving chamber 27 opposite from the second air inlet 28 and, at its outlet end, with a duct 31.

The duct 31 extends to a bagging machine (not shown), in which the glass fibre material is packaged in suitable plastic bags.

A blow back pipe 32, which converges with the duct 31 in the direction of travel of the glass fibre material along the duct 31, serves to allow air to escape from the duct 31 while the glass fibre material continues to travel at a reduced velocity along the duct 31 beyond the blow back pipe 32. The reduction of air velocity by allowing air to escape prevents further excessive delamination of the cut pieces into unsuitably small pieces.

The circular saw blades 14 of the first cutter 12 are spaced apart from one another by gaps of approximately 1 inch, so that the bonded glass fibre material strips 16 each have a width of approximately 1 inch.

These bonded glass fibre material strips are then cut by the fly knives 22*a* of the rotary cutter 22 along transverse lines of cut, i.e. lines of cut extending across the widths of the strips 16, at spacings of approximately $\frac{3}{4}$ inches.

Therefore, the individual cut pieces 23, as they drop from the rotary cutter 22, each have a dimension of 1 inch$\times\frac{3}{4}$ inch$\times$the compressed thickness (i.e. height, as viewed in FIG. 1) of the batt material 11.

As the cut pieces 23 are entrained in the main air stream through the nozzle 30 and the duct 31, they are further broken by delamination in the main air stream into pieces of glass fibre material having dimensions of approximately 1 inch$\times\frac{3}{4}$ inch$\times\frac{3}{4}$ inch.

It should be understood, however, that the dimensions quoted above are given by way of example only, and that the widths of the strips 16, and the spacing along the strips 16 of the transverse lines of cut by the rotary cutter 22, may be varied from those dimensions quoted above.

Figure 5:
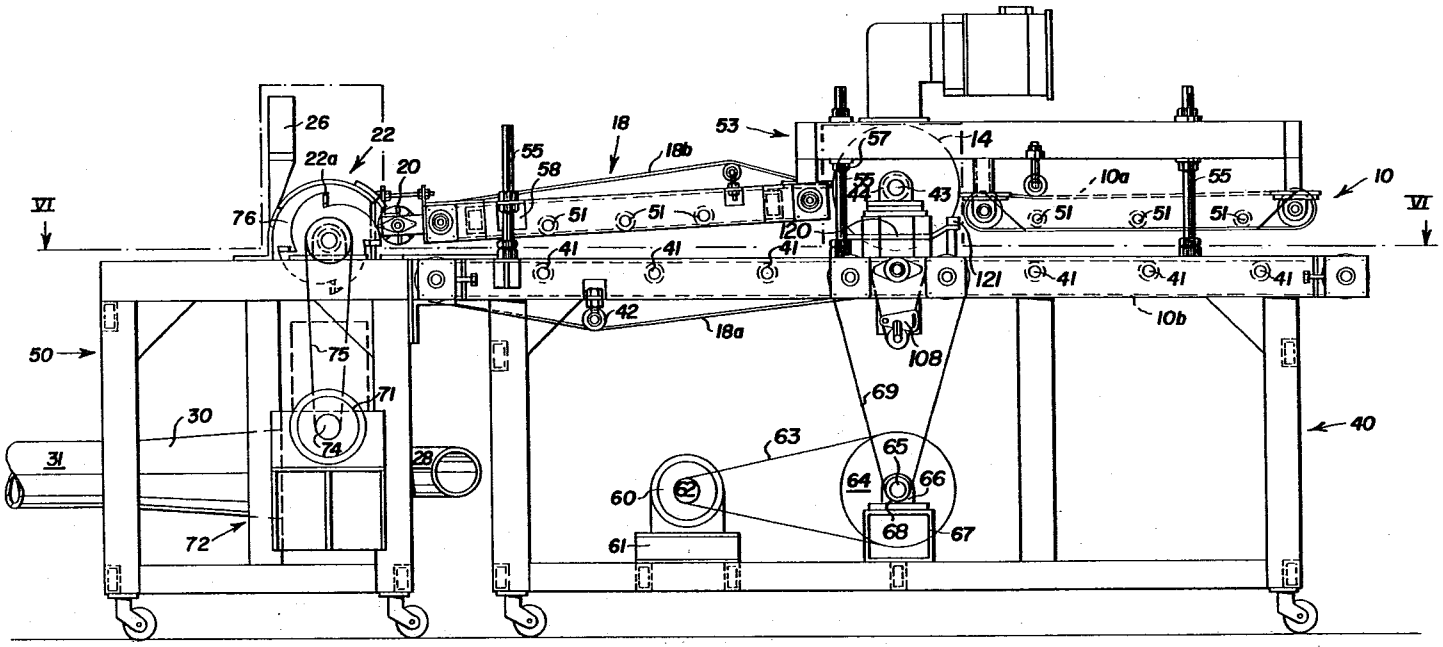
FIG. 5 shows, in side elevation, a more detailed view of the apparatus of FIG. 1.
Figure 6:
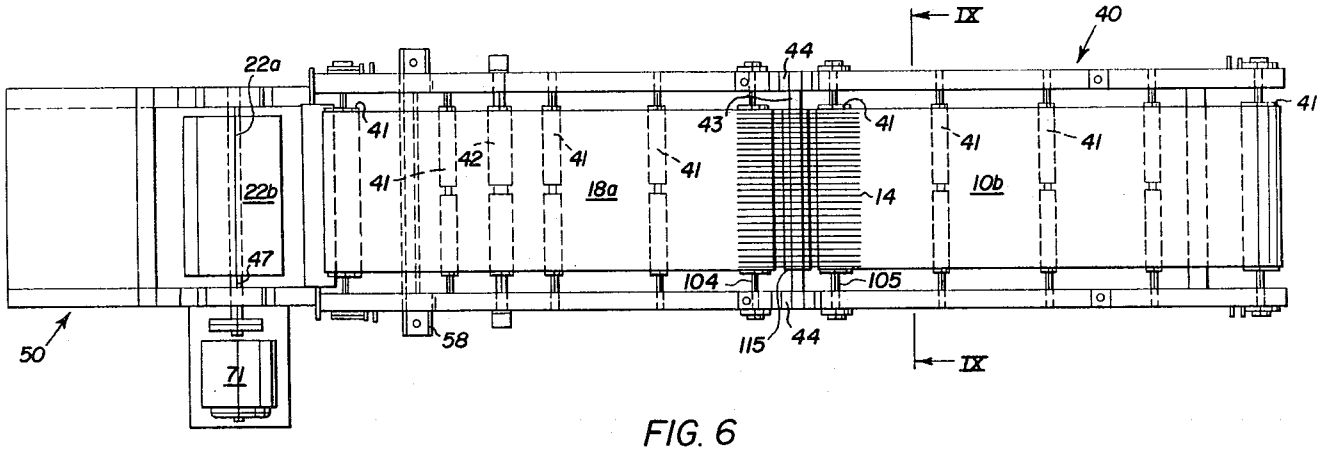
FIG. 6 shows a plan view of a lower part of the apparatus taken along the line VI—VI of FIG. 5.

As shown in FIGS. 5 and 6, which illustrate in greater detail the apparatus shown in FIG. 1, a main bed indicated generally by reference numeral 40 is provided with a plurality of transverse, freely rotatable rollers 41 for supporting the lower conveyor belts 10*b* and 18*a*, of which the latter is also provided with a tensioning roller 42.

The circular saw blades 14 are mounted on a shaft 43, which is journaled in pillow blocks 44 at opposite ends thereof, the pillow blocks 44 being mounted on the main bed 40. The spacings of the circular saw blades 14 along the shaft 43 are maintained by means of annular spacers 46 (FIG. 9) mounted on the shaft 43.

The rotor 22*b* of the rotary cutter 22 is mounted on a shaft 47 journaled in pillow blocks 48, at opposite ends thereof, which are mounted on an auxiliary bed indicated generally by reference numeral 50.

The upper conveyor belts 10*a* and 18*b* are carried on rollers 51, which are freely rotatably mounted on an upper support frame indicated generally by reference numeral 53.

The vaned roller 20 is supported at one end of the upper frame 53.

To enable adjustment of the height of the upper conveyor belts 18*b* and 10*a*, the upper frame 53 is vertically adjustably supported by means of six threaded rods 55, which are mounted on support brackets 56 secured to the main bed 40 and have nuts 57 in threaded engagement therewith, the nuts 57 serving to secure support brackets 58 fixed to the upper frame 53.

An electric drive motor 60, mounted on a support structure 61 on the main bed 40, transmits drive through a sheave 62 mounted on the drive shaft of the drive motor 60, a drive belt 63 and a sheave 64 to a shaft 65 mounting the latter.

The shaft 65 is mounted in pillow blocks 66, on a support structure 67 on the main bed 40, and carries a further sheave 68 for transmitting the drive through drive belt 69 to the endless belts 18*a* and 10*b* as described hereinafter.

A second electric drive motor 71 is mounted on a support structure indicated generally by reference numeral 72, which is fixed to the auxiliary bed 50. The motor 71 carries on its drive shaft a sheave 74 for transmitting drive, through a drive belt 75 and a further sheave 76 mounted on the cutter rotor shaft 47, to the cutter rotor 22*b*.

The housing 25 is mounted on the auxiliary bed 50, and the duct 31 extends to the left, as viewed in FIG. 5, from the housing 25.

Figure 7:
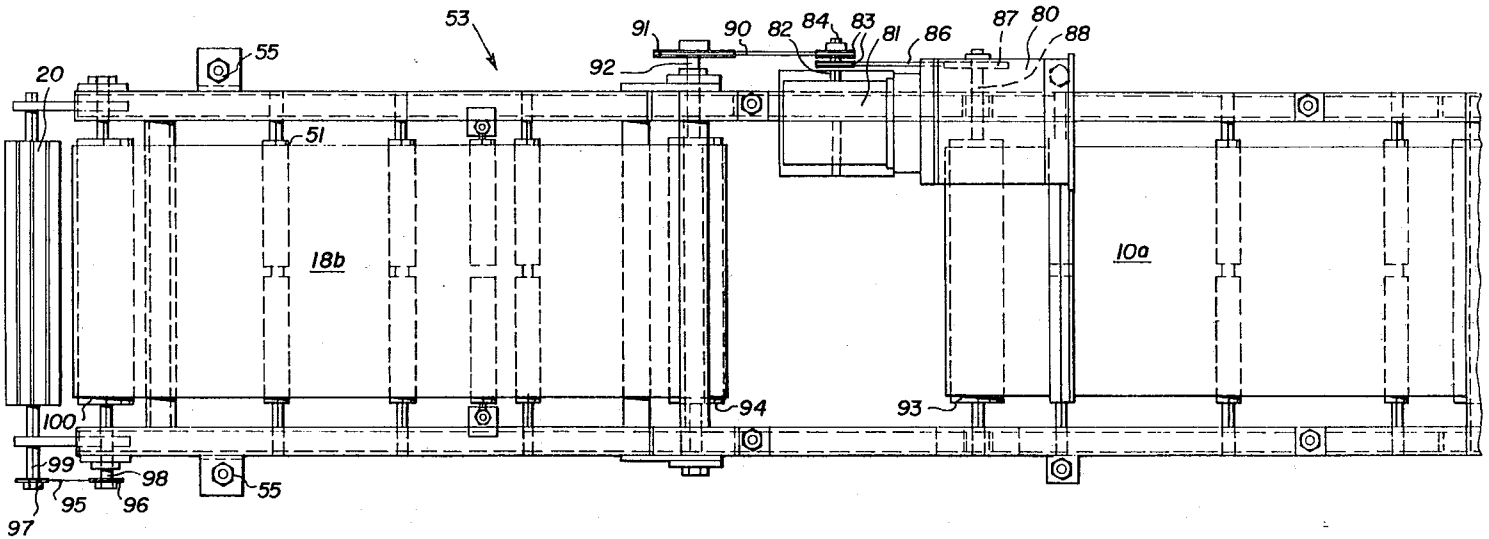
FIG. 7 shows a plan view of an upper part of the apparatus of FIG. 5.
Figure 8:
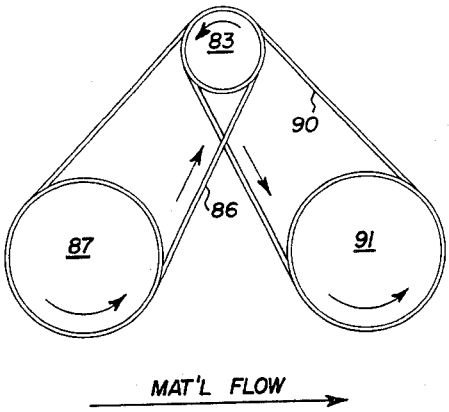
FIG. 8 shows part of a drive arrangement for the upper part of the apparatus of FIG. 5.

The upper endless conveyors 10*a* and 18*b* are driven by an electric motor 80 (FIG. 7) through a right-angled gear box 81 having an output drive shaft 82. A pair of sheaves 83 and 84 are mounted on the outward shaft 82 for rotation thereby. The sheave 83 drives an endless belt 86, which extends around the sheave 83 and a further sheave 87, which is mounted on a shaft 88 for transmitting the drive to the latter.

The sheave 83 drives an endless belt 90 extending around a sheave 91 mounted on a shaft 92.

The shafts 88 and 92 carry end rollers 93 and 94, respectively, of the conveyors 10*a* and 18*b*.

A drive transmission comprising an endless belt 95 extending around a pair of sheaves 96 and 97 transmits drive from a shaft 98, carrying the sheave 96, to a shaft 99, carrying the sheave 97. The shaft 98 carries an end roller 100 of the endless conveyor belt 18*b* and the shaft 99 carries the vaned roller 20. With this drive arrangement, the movement of the upper conveyor 18*b* is transmitted through the roller 100, the shaft 98, the sheaves 96 and 97, the endless belt 95 and the shaft 92 to the vaned roller 20, so that the latter is rotated in timed relation to the movement of the upper conveyor 18*b*.

Figure 9:
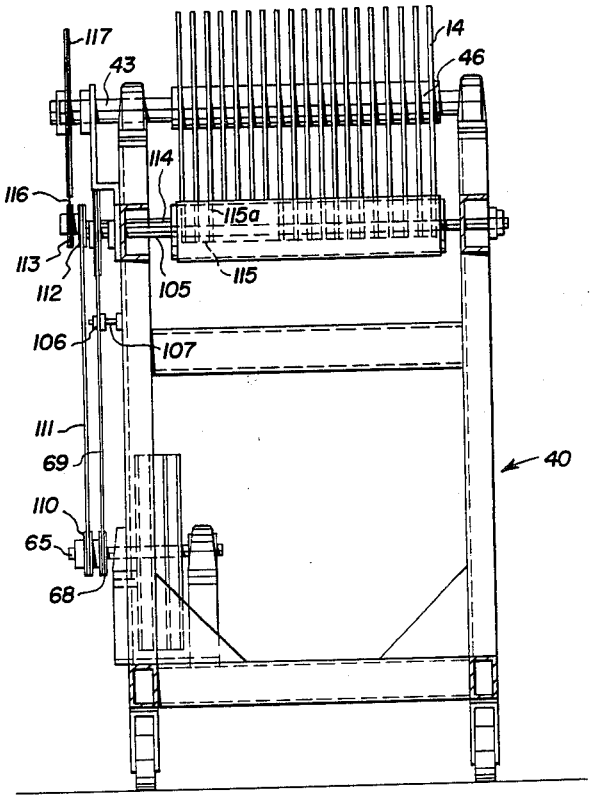
FIG. 9 shows a view taken in section along the line IX—IX of FIG. 6.
Figure 10:
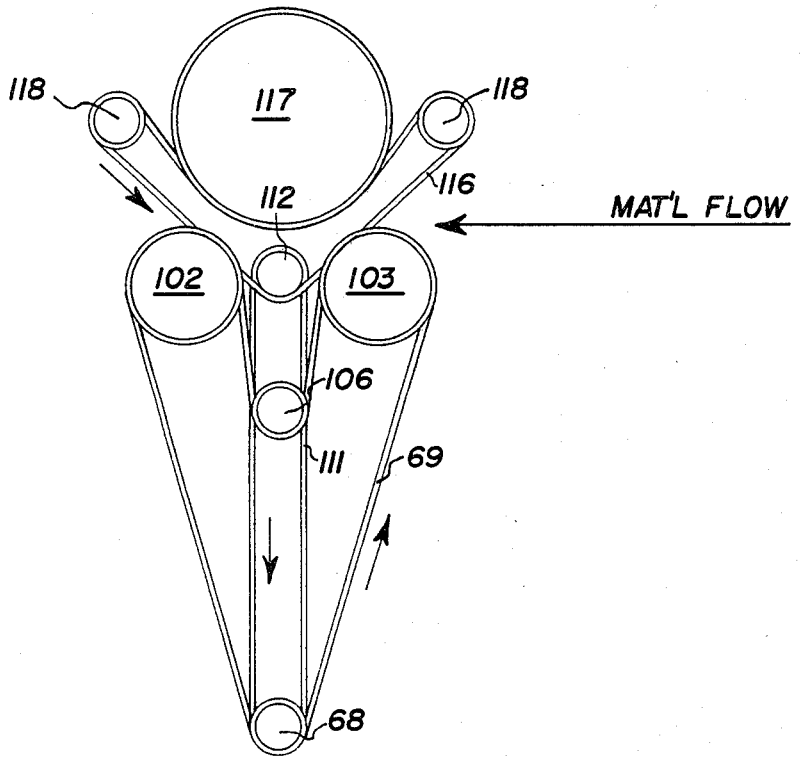
FIG. 10 shows parts of a drive arrangement for the lower part of the apparatus of FIG. 5.

The endless drive belt 69 (FIG. 5) extends around a pair of sheaves 102, 103 (FIG. 10), which are mounted on respective shafts 104, 105 of respective end rollers 41 of the two lower conveyors 18*a* and 10*b*. The belt 69 further extends around a sheave 106 carried on a shaft 107 which is rotatably mounted on the machine bed 40, as shown in FIG. 9.

The shaft 65 (FIG. 9) carries a further sheave 110 which, through an endless belt 111, drives a pair of sheaves 112 and 113 mounted on a shaft 114 journalled in the machine bed.

The shaft 114 carries a roller 115, which is formed with peripheral grooves 115*a* receiving the outer peripheries of the saw blades 14, the shaft 114 being mounted directly below the shaft 43 carrying the saw blades 14. The provision of the grooved roller 115, cooperating with the saw blades 46, ensures that the glass fibre material is cleanly cut by the saw blades 46.

The sheave 113 is connected by an endless belt 116 and a sheave 117 mounted on the shaft 43 for rotating the latter and, therewith, the saw blades 14.

Referring again to FIG. 5, a plurality of generally horizontal fingers 120, of which only one is shown, extend between each adjacent pair of saw blades 114, the fingers 120 being mounted on a bridge 121 extending horizontally and transversely above the path of the glass fibre material. The fingers 120 serve to press against the top of the glass fibre material, as it passes the saw blades 14 and is cut into strips thereby to prevent the strips from being lifted by the rotating saw blades 14.

In operation of the above-described apparatus, the bonded glass fibre batt material is fed from the right to the left, as viewed in FIG. 5, and cut into the individual cut pieces 27, which are then subsequently delaminated, as described hereinabove with reference to FIG. 1.

The apparatus can readily be adjusted to accept batts of different thicknesses by adjusting the height of the upper support frame 53 by means of the nuts 57 engaging the vertical support rods 55.

The width of the strips 16 can readily be varied by replacing the circular saw blade spacers 46 by corresponding spacers of different thickness.

The strips 16 are then chopped into the individual cut pieces by means of the rotary cutter 22 and, more particularly, by a cutting action between the fly knives 22*a* and the fibre material support plate 19, which is mounted on the auxiliary bed 50.

In order to ensure that the strips 16 are not carried around by the rotating circular saw blades 14, a plurality of fingers 120 extend through each of the gaps between the blades 14 at the top of the path of the batts, the fingers 120 being mounted on a support 121 which, in turn, is mounted on the main bed 40 and which bridges the path of the batts.

The size of the cut pieces 23 as they drop from the rotary cutter 22 may be within the range from $\frac{1}{2}$ inch$\times\frac{1}{2}$ inch$\times$H to $1\frac{1}{2}$ inch$\times 1\frac{1}{2}$ inch$\times$H where H corresponds to the height of the batts 11, and is preferably $\frac{3}{4}$ inch$\times$1 inch$\times$H.

As mentioned hereinbefore, the cut pieces 23 are reduced in size by delamination in the main air stream, so that the dimension H is reduced.

Moreover, further delamination occurs during air handling or blowing of the blowing wool when it is being installed in its position of use, and field tests have shown that the final magnitude of the dimension H is random within the range of $\frac{1}{2}$–1 inch.

I claim:

1. A method of producing blowing wool from bonded, laminated, glass fibre material, comprising the steps of:

cutting the glass fibre material into a plurality of strips;

cutting said strips across the lengths thereof to form individual substantially rectangular shaped cut pieces of said glass fibre material;

delaminating said individual cut pieces into smaller pieces having the shape of rectangular parallelepipeds by subjecting said cut pieces to an air stream; and subsequently controlling the velocity of said air stream and the movement of the pieces treated thereby to avoid excessive delamination of said smaller pieces.

2. A method as claimed in claim 1, further including pneumatically conveying the cut pieces in said air stream.

3. A method as claimed in claim 2, which includes dropping said cut pieces into said air stream, directing said air stream towards a nozzle to feed said cut pieces through said nozzle and along a duct having an opening disposed at a point intermediate along the length thereof, and allowing air to escape from said duct through said opening in said duct such that said smaller pieces travel along said duct to beyond said opening at a reduced velocity.

4. A method as claimed in claim 1, which includes directing a stream of air onto said cut pieces, at a position at which said cut pieces are cut, to cause said cut pieces to drop from said position.

5. A method as claimed in claim 1, further including the step of compressing said strips prior to the cutting of said strips across the lengths thereof.

6. The method of claim 1, wherein the delaminated individual smaller pieces are cuboid-shaped pieces.

7. A method of producing blowing wool from a felt of bonded glass fibre batt material, comprising the steps of:

conveying said glass fibre material felt along a predetermined path of travel to successive first and second cutting positions;

cutting said glass fibre material felt at said first cutting position along a plurality of lines of cut spaced apart across the path of travel, into a plurality of strips;

compressing said strips between said first and second cutting positions;

cutting said strips at said second cutting position along a second line of cut extending across the path of travel to form substantially rectangular shaped individual cut pieces of said glass fibre material;

delaminating said cut pieces into smaller pieces of glass fibre material by entraining said cut pieces in an air stream; and subsequently reducing the velocity of said air stream to avoid excessive delamination of said smaller pieces.

8. A method as claimed in claim 7, which includes directing a downward travelling air flow onto said cut pieces adjacent said second line of cut to cause said cut pieces to drop, and directing said air stream horizontally at said cut pieces, as said cut pieces drop.

9. A method as claimed in claim 8, which includes entraining said cut pieces in said air stream along a duct in a predetermined direction and allowing some of the air stream to escape from said duct at a predetermined position such that said smaller pieces continue to be entrained along said duct beyond said predetermined position at a reduced velocity.

10. A method as claimed in claim 7, which includes entraining said cut pieces by said air stream through a convergent passage.

* * * * *

Notice of Adverse Decisions in Interference

In Interference No. 101,993, involving Patent No. 4,347,985, R. B. Simpson, MANUFACTURE OF GLASS FIBRE BLOWING WOOL, final judgment adverse to the patentee was rendered Feb. 27, 1991, as to claims 1-10.

*(Official Gazette August 27, 1991)*